US006640877B2

(12) United States Patent
Soderstrom et al.

(10) Patent No.: US 6,640,877 B2
(45) Date of Patent: Nov. 4, 2003

(54) INVESTMENT CASTING WITH IMPROVED MELT FILLING

(75) Inventors: Mark L. Soderstrom, Fruitport, MI (US); Bart M. Kilinski, Montague, MI (US); John R. Brinegar, Muskegon, MI (US); Brad J. Murphy, Whitehall, MI (US)

(73) Assignee: Howmet Research Corporation, Whitehall, MI (US)

( * ) Notice: Subject to any disclaimer, the term of this patent is extended or adjusted under 35 U.S.C. 154(b) by 0 days.

(21) Appl. No.: 10/186,172

(22) Filed: Jun. 27, 2002

(65) Prior Publication Data

US 2003/0024681 A1 Feb. 6, 2003

Related U.S. Application Data

(63) Continuation-in-part of application No. 09/441,259, filed on Nov. 16, 1999, now Pat. No. 6,453,979, which is a continuation-in-part of application No. 09/253,982, filed on May 14, 1998, now Pat. No. 6,019,158.

(51) Int. Cl.[7] ..... B22D 27/00; B22D 18/00

(52) U.S. Cl. ..... 164/122.1; 164/66.1; 164/119; 164/120; 164/62; 164/133

(58) Field of Search ..... 164/122.1, 66.1, 164/119, 120, 62, 133, 337, 284, 259, 254

(56) References Cited

U.S. PATENT DOCUMENTS

| | | | | |
|---|---|---|---|---|
| 969,539 A | | 9/1910 | Kitchen | 164/304 |
| 1,320,824 A | | 11/1919 | Bailey et al. | 164/154.8 |
| 1,690,750 A | | 11/1928 | Moyer | 164/66.1 |
| 1,758,380 A | | 5/1930 | Spiro | 164/305 |
| 1,962,456 A | | 6/1934 | Myers | 22/69.1 |
| 3,228,073 A | | 1/1966 | Harrison et al. | 22/73 |
| 3,420,291 A | | 1/1969 | Chandley et al. | 164/66 |
| 3,853,635 A | | 12/1974 | Demendi | 148/3 |
| 3,865,175 A | | 2/1975 | Listhuber et al. | 164/82 |
| 3,892,272 A | | 7/1975 | Troy et al. | 164/306 |
| 4,021,910 A | * | 5/1977 | Freeman, Jr. et al. | 29/526.2 |
| 4,049,041 A | | 9/1977 | Nikolov et al. | 164/120 |
| 4,186,791 A | | 2/1980 | Sladkoshteev et al. | 164/66 |
| 4,425,932 A | | 1/1984 | Herman | 137/143 |
| 4,478,270 A | | 10/1984 | Rosenthal et al. | 164/254 |
| 4,593,741 A | | 6/1986 | Caugherty | 164/337 |
| 4,733,714 A | | 3/1988 | Smith | 164/130 |
| 4,830,090 A | | 5/1989 | Takeuchi et al. | 164/488 |
| 4,832,105 A | | 5/1989 | Nagan et al. | 164/61 |
| 5,058,653 A | | 10/1991 | Garat | 164/34 |
| 5,109,914 A | | 5/1992 | Kidd et al. | 164/113 |
| 5,181,551 A | | 1/1993 | Kidd et al. | 164/113 |
| 5,199,482 A | | 4/1993 | Riihle | 164/120 |
| 5,299,619 A | | 4/1994 | Chandley et al. | 164/53 |
| 5,301,739 A | | 4/1994 | Cook | 164/97 |
| 5,335,711 A | | 8/1994 | Paine | 164/66.1 |
| 5,388,633 A | | 2/1995 | Mercer, II et al. | 164/457 |
| 5,390,724 A | | 2/1995 | Yamauchi et al. | 164/147.1 |
| 5,592,984 A | * | 1/1997 | Schmiedeknecht et al. | 164/62 |
| 6,019,158 A | | 2/2000 | Soderstrom et al. | 164/133 |
| 6,453,979 B1 | * | 9/2002 | Soderstrom et al. | 164/133 |

* cited by examiner

*Primary Examiner*—M. Alexandra Elve
*Assistant Examiner*—I. H. Lin

(57) ABSTRACT

Molten metallic material is cast into a mold that is made with a barrier to reduce gas permeability through a mold wall that forms on its innermost side a mold surface for contacting the molten metallic material. The molten metallic material is gravity cast into the mold residing in a furnace in a casting chamber under a first pressure, such as subambient pressure. Then, a gaseous pressure is provided in the casting chamber higher than the first pressure rapidly enough to reduce or eliminate the presence of localized voids in the casting solidified in the mold.

13 Claims, 2 Drawing Sheets

INVESTMENT CASTING WITH IMPROVED MELT FILLING

This application is continuation-in-part of Ser. No. 09/441,259 filed Nov. 16, 1999 now issued as U.S. Pat. No. 6,453,979, which is a continuation-in-part of Ser. No. 09/253,982 filed May 14, 1998, now U.S. Pat. No. 6,019, 158.

FIELD OF THE INVENTION

The present invention relates to casting and, more particularly, to investment casting of a metallic material in a mold in a manner that improves filling of mold and core surface features and reduces casting voids.

BACKGROUND OF THE INVENTION

In the manufacture of components, such as nickel base superalloy turbine blades and vanes, for gas turbine engines, directional solidification investment casting techniques using gas permeable shell molds have been employed in the past to produce single crystal or columnar grain castings having improved mechanical properties at high temperatures encountered in the turbine section of the engine.

In the manufacture of turbine blades and vanes for modern, high thrust gas turbine engines, there has been a continuing demand by gas turbine manufacturers for internally cooled blades and vanes having complex, internal cooling passages including such surface features as pedestals, turbulators, and turning vanes in the passages to control the flow of air through the passages in a manner to provide desired cooling of the blade or vane. These small cast internal passage surface features typically are formed by including a complex ceramic core in the mold cavity in which the melt is cast. The presence of the complex core having small dimensional surface features to form pedestals, turbulators, turning vanes or other internal cast surface features renders filling of the mold cavity about the core with melt more difficult and more prone to inconsistency. Wettable ceramics and increased metallostatic head on the mold have been used in an attempt to improve mold filling and reduce localized voids in such situations.

U.S. Pat. No. 5,592,984 describes a method of casting a metallic material wherein molten metallic material is introduced into a gas permeable shell mold in a casting furnace under an initial relative vacuum and then a gaseous pressure is applied on the molten metallic material cast in the mold while the mold resides in the casting furnace to improve mold filling and reduce localized void regions in the casting. This method has been successful to improve filling of potential void regions located at ceramic core surface features contacting the molten metallic material (i.e. so-called internal void regions at the core surfaces). This method has been less effective in filling of mold surface features contacting the molten metallic material (i.e. so-called external void regions at the mold surfaces).

SUMMARY OF THE INVENTION

In one embodiment of the invention, molten metallic material is cast into a mold that is provided with a refractory barrier to gas permeability effective to delay gas pressure equalization between an exterior and interior of the mold wall that forms mold surface features for contacting the molten metallic material. The molten metallic material is cast into the mold residing in a casting chamber under a first pressure. Then, gaseous pressure is provided in the casting chamber that is higher than the first pressure rapidly enough to reduce or eliminate the presence of localized voids in the casting solidified in the mold.

In a particular embodiment of the invention, the mold wall is provided with a substantially gas impermeable refractory glaze barrier layer at a time when the mold contains molten metal such that the mold wall is substantially gas impermeable through its thickness. The barrier layer retards gas pressure equalization between an exterior and interior of the mold wall and thereby improves filling at mold and core surface features contacting the molten material. An illustrative refractory barrier layer includes a glaze that comprises, before glazing, a majority of silica, a minority of alumina and other oxides.

In a particular embodiment of the invention, the first pressure can comprise a subambient pressure (e.g. a relative vacuum) or ambient pressure (e.g. atmospheric pressure). The higher gaseous pressure is subsequently applied to the molten material in the mold by backfilling the casting chamber with a pressurized gas. Preferably, the gaseous pressure comprises a pressurized gas that is substantially nonreactive with the melt, such as an inert gas.

In another particular embodiment of the invention for making a directionally solidified casting such as a columnar grain or single crystal casting, an investment mold having a plurality of mold cavities and a barrier to gas permeability is disposed on a chill member in the casting chamber, molten metallic material is introduced into the mold so that it flows by gravity from a pour cup through a respective passage to each mold cavity to fill the mold cavities and contact the chill member for unidirectional heat removal, and then the higher gaseous pressure is applied to the material cast in the mold rapidly enough after introduction into the mold to reduce localized void regions present in the cast material.

The above advantages of the invention will become more readily apparent from the following detailed description taken with the following drawings.

DESCRIPTION OF THE INVENTION

Figure 1:
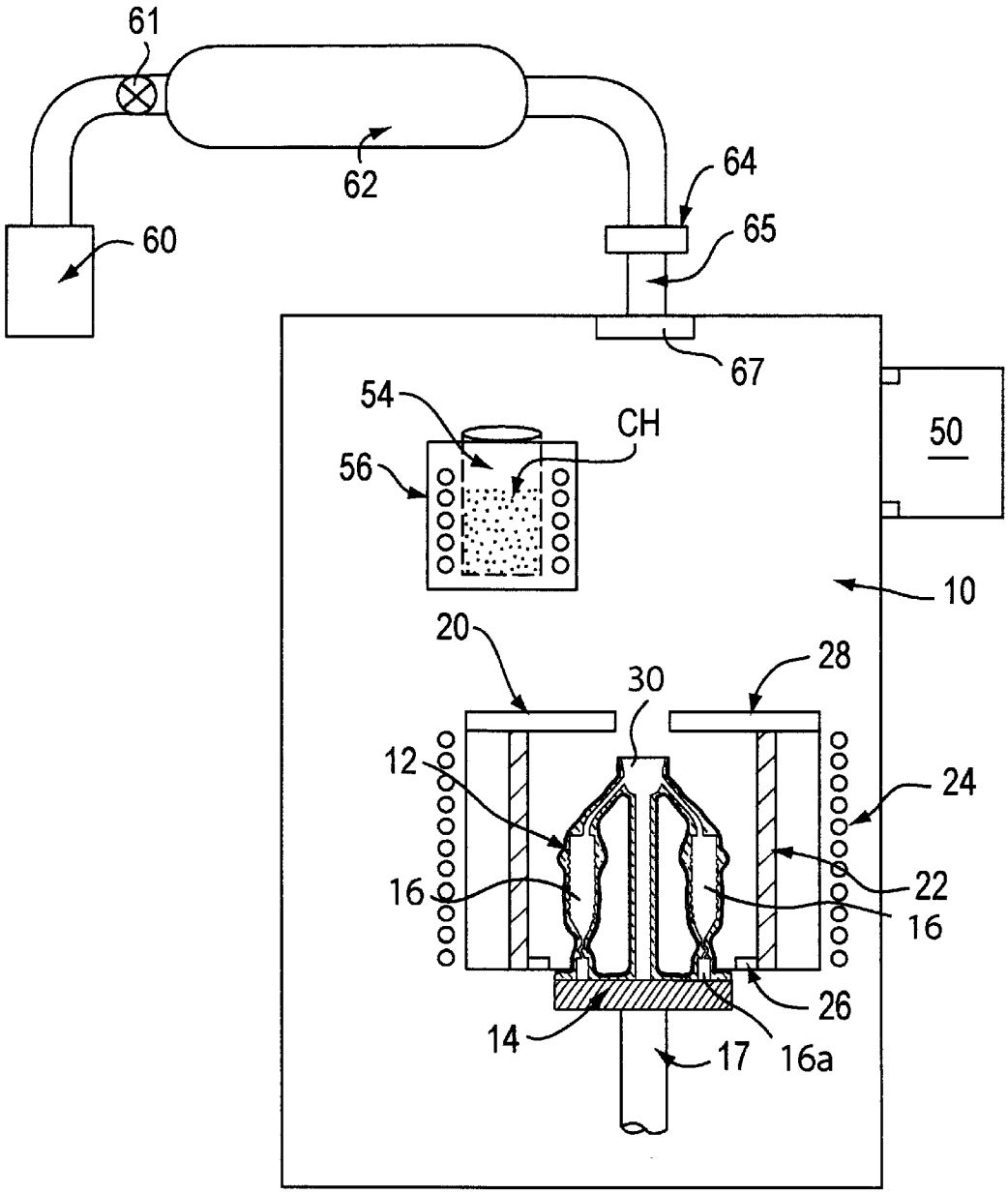
FIG. 1 is a schematic view of apparatus for practicing one embodiment of the invention to make columnar grain or single crystal castings, the mold assembly being shown schematically for purposes of convenience.
Figure 2:
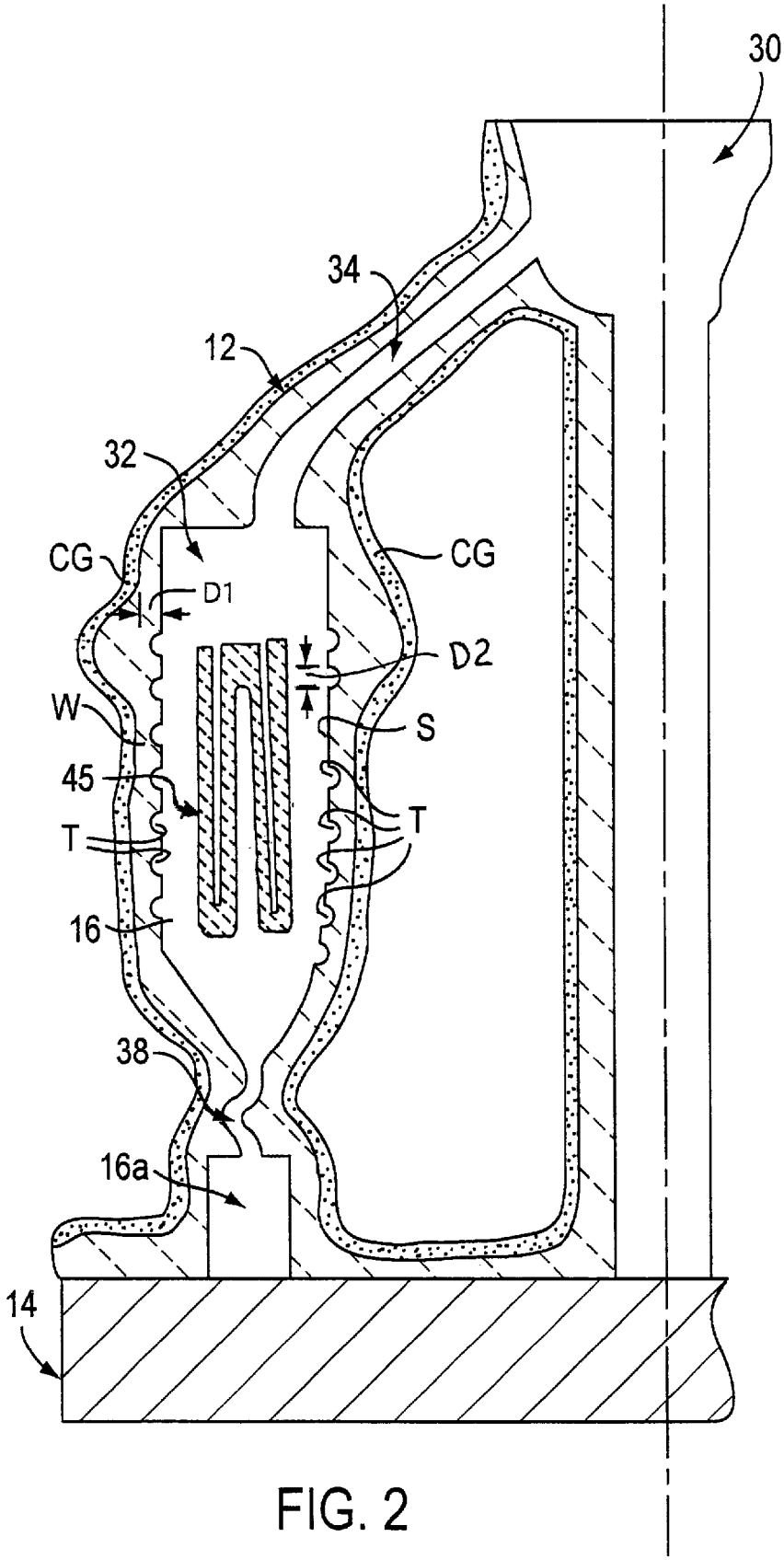
FIG. 2 is an enlarged view of a portion of an investment shell mold useful in practice of the invention.

Referring to FIGS. 1 and 2, casting apparatus for practicing an embodiment of the invention to produce a plurality of single crystal castings is shown for illustration only and not limitation since the invention is not limited to the particular casting apparatus shown or to the casting of single crystal castings. The invention can be practiced in conjunction with a wide variety of casting apparatus that can effect casting of molten metallic material into a mold residing in a casting chamber at subambient, ambient or other pressure and that can apply a higher gaseous pressure rapidly enough after material is introduced into the mold to reduce or eliminate the presence of localized voids in the casting solidified in the mold. The invention can be practiced to produce equiaxed metallic castings and directionally solidified (DS) metallic castings having a single crystal, columnar grain, or directional eutectic microstructure of a variety of metals and alloys.

For purposes of illustration and not limitation, a casting apparatus includes a vacuum casting chamber 10 in which a ceramic investment shell mold assembly 12 is disposed on a chill member (e.g. plate) 14 in conventional manner to produce single crystal or DS castings. The mold assembly on chill member initially resides in a casting furnace 20. A portion of the mold assembly 12 is shown in more detail in FIG. 2 where it is apparent that each mold cavity 16 of the mold assembly 12 communicates with the chill member 14 via a respective grain growth cavity 16*a* having an opening at its lowermost or bottom adjacent the chill member. The mold assembly includes a plurality of mold cavities 16 disposed about and directly communicating with a pour cup 30 via a respective filling passage 34 as shown, for example, in FIG. 2 and in U.S. Pat. No. 3,763,926, the teachings of which are incorporated herein by reference with respect to the mold assembly configuration. Molten metallic material flows by gravity from the pour cup 30 through passages 34 into the mold cavities 16. The chill member 14 is disposed on a movable shaft 17 that effects withdrawal of the mold assembly from casting furnace 20 after the mold assembly is filled with molten metallic material, such as nickel or cobalt based superalloy, to effect directional solidification of the metallic material in the mold cavities.

The furnace 20 is of conventional construction and includes a tubular susceptor 22 typically comprising a graphite sleeve and an induction coil 24 disposed about the susceptor by which the susceptor is heated for in turn heating the mold assembly 12 prior to filling with the molten metallic material. Heat shield 26 is positioned at the lower end of the susceptor proximate the periphery of the chill member 14. A removable heat shield cover 28 is disposed on the top of susceptor 22 and may include an opening for receiving a molten metallic material which is introduced to an upper pour cup 30 of the mold assembly 12.

The pour cup 30 of the mold assembly communicates to the filling passages 34 that in turn communicate to each mold cavity 16 for feeding by gravity molten metallic material thereto. Each growth cavity 16*a* communicates to a respective mold cavity 16 via a crystal selector passage 38, such as a pigtail or helical passage, such that one of the many crystals propagating upwardly in each growth cavity from the chill member is selected for further propagation through the each mold cavity thereabove to form a single crystal casting having a shape complementary to the shape of the mold cavity. Above each
mold cavity is a riser cavity 32 that provides a source of melt to the mold cavity to accommodate shrinkage during solidification as well as metallostatic pressure or head on the melt as it solidifies in the mold cavity. In making columnar grain castings, the crystal selector passage 38 is omitted from beneath each mold cavity, leaving the growth cavity 16*a* therebelow, as those skilled in the art will appreciate. Manufacture of equiaxed castings does not employ the chill member 14 or any growth cavity beneath the mold cavity.

The mold assembly 12 typically comprises a ceramic investment shell mold assembly having the features described and formed by the well known lost wax process wherein a wax or other fugitive pattern of the mold assembly is repeatedly dipped in ceramic slurry (ceramic fluor in a liquid binder), drained of excess slurry, stuccoed with coarse ceramic stucco, and dried to build up the desired shell mold wall thickness on the pattern. The pattern then is removed from the invested shell mold, and the shell mold is fired at elevated temperature to develop adequate mold strength for casting. The mold wall W of each shell mold cavity 16 formed by the lost wax process thus typically comprises multiple layers of fine and coarse ceramic particles built on one another with the particles bonded together by interparticle sintering from the mold firing treatment. The mold wall W typically has a wall thickness of ¼ inch to ¾ inch and is permeable to gas after pattern removal especially when a differential gas pressure exists across the mold wall thickness. The mold wall W of each mold cavity 16 forms at its innermost surface or side an inner mold surface S for contacting and shaping the molten metallic material cast and solidified in the mold cavities 16. The shape of the inner mold surface S is imparted by the shape of the fugitive pattern of the casting to be produced as is well known. The mold surface S forming each mold cavity 16 in turn forms the exterior surface of the casting solidified in each mold cavity. If a casting is to be produced having internal passages and the like, each mold cavity 16 will have a conventional ceramic core 45 disposed therein by core bumpers, chaplets, pins and other known techniques which bumpers etc. form no part of the invention. The ceramic core 45 forms the internal surface of the casting solidified in each mold cavity. Although not shown each ceramic core 45, if present, extends outside its mold cavity 16 so that a portion of the core is accessible after the casting is solidified in mold cavity 16 to allow for core removal as is well known.

The mold surface S forming each mold cavity 16 may include small dimensioned (small size) surface features that are difficult to fill with molten metallic material as a result of the small size and surface tension effects between the molten material and the mold surface. In particular, the inventors have discovered that small dimensioned mold surface features, such as concave turbulators T on surface S, FIG. 2, having a height-to-width ratio of 1.0 or greater are difficult to fill with melt by practice of the casting process of U.S. Pat. No. 5,592,984, the teachings of which are incorporated herein by reference, using a conventional gas permeable investment shell mold assembly 12 made by the lost wax process. The greater the height-to-width ratio, the more difficult it is to fill the surface feature. For purposes of illustration and not limitation, small surface features having a dimension D1 perpendicular to the mold surface S (height) of 0.005 inch and greater, such as from 0.005 to 0.020 inch, and a width dimension D2 transverse to the height dimension of 0.030 inch or less have been difficult to fill. For example, almost none of concave turbulators having D1 and D2 less than 0.020 inch on the mold surface S was filled in practice of the process of that patent using a conventional shell mold assembly 12.

In accordance with an illustrative embodiment of the present invention, the mold assembly 12, or portions thereof forming the mold cavities 16, is/are provided with a refractory barrier CG to gas permeability through the mold wall W that forms the mold surface S that contacts the molten metallic material. The refractory barrier renders the mold wall substantially gas impermeable through its thickness and thereby delays gas pressure equalization between the exterior and interior of the mold wall W.

The refractory barrier to gas permeability can be provided in or on the mold wall at any stage in the normal manufacture of the mold by build-up of the slurry layers and stucco layers, after the green shell mold is dried, during the pattern removal operation, or even after the mold is fired or during mold preheating in preparation for casting so as to impart reduced gas permeability to the mold at the critical time of casting while the metal in the mold is still molten. The refractory barrier can comprise a refractory layer in the mold wall, a refractory layer or coating on the exterior of the mold wall, FIG. 2, or mold wall section densified in suitable manner to provide mold wall W with minimal or no gas permeability.

A refractory coating can comprise for purposes of illustration only a refractory glaze having composition selected in dependence on the ceramic mold materials (ceramic flour and stucco) used in its fabrication. The glaze material can be applied as intermediate slurry layer during mold fabrication so as to be incorporated in the mold wall W, as the last slurry layer during mold fabrication so as to be incorporated in the mold wall W, or as a coating on the exterior of the mold wall by dipping or otherwise coating the exterior surfaces of the mold assembly in or with glaze material. The glaze material can be applied before or after the fugitive pattern is removed form the shell mold. If the glaze material is applied before the pattern is removed, the glaze material is air permeable to allow the pattern to be removed from the shell mold before the glaze material is subjected to heating to effect glazing action. After the mold assembly 12 is made, it can be heated to an appropriate glazing temperature in a separate heating step or during conventional mold assembly preheating prior to casting conducted inside or outside the casting chamber 10 to bring the mold assembly to a suitable elevated temperature for casting of molten metallic material therein. If desired, the temperature of the mold assembly can be reduced below the glazing temperature for subsequent casting depending upon the particular metal or alloy being cast. The glaze layer CG formed on or in the shell mold wall W typically is gas impermeable or at least exhibits reduced gas permeability. A typical glaze thickness on the mold assembly is 0.006 inch to 0.008 inch.

The invention is not limited to glazing to reduce gas permeability of the mold wall W. Other coating materials and/or mold fabrication techniques to reduce mold wall gas permeability can be used to practice the invention where gas permeability is reduced to delay or retard gas pressure equalization across the mold wall W so as to reduce or eliminate void regions at the mold surface S on the casting. For example, the mold assembly can be fabricated to have a wall structure that is rendered less gas permeable by including a sintering agent or fluxing agent in one or more shell mold layers, to better bond the ceramic particulates, by choosing suitably sized refractory particles in one or more slurries, and/or by deposition of a refractory solid or liquid in the shell mold wall to achieve reduced gas permeability.

In practicing an embodiment of the invention using the apparatus of FIG. 1, the vacuum casting chamber 10 initially is evacuated by vacuum pump 50 to a vacuum level (subambient pressure) of 5 microns or less. The mold cavities 16 likewise will be evacuated as a result of the mold assembly 12 being disposed in the chamber 10. Also prior to introducing molten metallic material, the mold assembly 12 is preheated to an elevated casting temperature (e.g. 2800 degrees F. for a nickel base superalloy) by energization of induction coil 24 disposed about susceptor 22. The mold preheat temperature depends upon the metal or alloy being cast.

The molten metal or alloy is provided by melting a charge CH in crucible 54 disposed in the evacuated chamber 10 by energization of induction coil 56 about the crucible pursuant to conventional practice. The crucible 54 however, alternatively may hold a molten charge that has been melted in a separate vessel and transferred to crucible 54. The molten metallic material in crucible 54 is heated to an appropriate superheat above its melting point and then introduced into the mold assembly 12 by pouring into the pour cup 30 by rotation of crucible 54 in known manner. The superheated metallic material flows down the filling passages 34 to each mold cavity 16 and then into each growth cavity 16*a*. Filling is complete when each riser cavity 32 and filling passage 34 is full to a level corresponding the level of material in the pour cup 30.

After the molten material is poured into and fills the mold assembly 12 and enters the riser cavities 32 and filling passages 34, the vacuum chamber 10 is backfilled with gas, such as typically inert gas (e.g. argon) or other gas that is substantially nonreactive with the melt in the mold assembly, to a higher gaseous pressure than the initial vacuum level (initial subambient pressure). A relatively higher gaseous pressure thereby is applied to the molten material in riser cavities 32 and hence to the molten material residing in the mold cavities 16. The gas pressure is ramped up rapidly enough to a sufficiently high pressure level after introduction and filling of mold assembly with the molten material to overcome and collapse localized void regions present in the molten material at the mold surface S, especially at small dimension mold surface features such as turbulators T on surface S, and also at similar small dimension surface features (not shown) that may be present on ceramic core 45, which optionally may be disposed in the mold cavity, such small dimension mold and/or core surface features being difficult to fill as a result of surface tension effects between the molten material and the mold and/or core surface.

The time of pressurization typically is determined by monitoring pressure sensors (not shown) in the chamber 10 to determine when the pressure sensors provide a stable pressure value, typically approximately 2 seconds. In particular, the gaseous pressure is ramped up rapidly enough to collapse any localized voids at the mold and/or core surface features before gas pressure equalization with the void regions occurs as a result of gas permeation through the mold walls W. The degree or magnitude of gas pressure applied typically is determined by the dimensions of the mold and/or core surface features to be filled or contacted with melt. Gas pressurization is established prior to withdrawal or removal of the mold assembly 12 from the furnace 20 for directional solidification of the melt in the mold cavities. That is, gas pressurization of chamber 10 occurs while the melt-filled mold assembly 12 still resides in the furnace 20 and prior to withdrawal of the mold assembly from the furnace for directional solidification to form single crystal castings.

The argon or other gas is introduced into the vacuum chamber from a pressure vessel 62 as described in U.S. Pat. No. 5,592,984, the teachings of which are incorporated herein by reference. The gas pressure is supplied from the vessel 62 through an electrically actuated, fast acting ball valve 64 that is able to open (or close) completely in very rapid manner (e.g. in less than one second) and a large diameter (e,g, 3 inches diameter) copper or other tube 65 communicated to chamber 10. A gas diffuser 67 shown schematically and described in U.S. Pat. No. 5,592,984 is fastened to the top of the chamber 10 at the inlet of the tube 65 to the chamber 10 to reduce velocity of the gas entering the chamber 10. In lieu of the gas diffuser, the diameter of the tube 65 can be substantially increased to this end, such as from 3 inches to 6 to 8 inches.

A predetermined argon backfill pressure can be provided rapidly to chamber 10 using the apparatus of FIG. 1. Typical backfill pressures of 0.5 to 0.9 atmosphere of argon can be achieved or established in the chamber 10 nearly instantaneously using the apparatus; e.g. in slightly more than one second, by the apparatus' s operator pushing an electrical actuator button to open fast acting valve 64 when the riser cavities 32 are observed to be filled.

The final pressure in chamber 10 is predetermined by controlling the initial pressure and volume of the pressure vessel 62. The pressure vessel 62 is filled from an argon or other gas source 60 via shutoff valve 61 prior to discharging the pressure vessel into the discharge tube 65 to ramp up gas pressure in chamber 10. The gas pressure can be maintained for different times ranging from a fraction of a minute up to the time for complete withdrawal of the mold assembly 12 from the furnace 20. Alternately, the gas pressure can be rapidly established after mold filling for a short time (e.g. 0.1 to 3 seconds) followed by evacuation of chamber 10 to return to the initial vacuum level during subsequent mold withdrawal.

For purposes of illustrating and not limiting the invention, a shell mold assembly was made by the lost wax process using ceramic slurries including zircon flour and alumina stucco to form a mold wall thickness of ¼ inch. The mold assembly included mold cavities to form elongated bar-shaped test samples having hundreds of turbulators having a height (D1) perpendicular to the mold surface of only 0.020 inch or less and a width (D2) of 0.030 inch or less of each mold cavity. During mold manufacture using the lost wax process, a ceramic glaze material was applied on the mold as the last slurry layer. Subsequent to pattern removal, the mold was fired in furnace 20 at 2800 degrees F. for 45 minutes as part of the normal mold preheating step prior to introduction of the molten metal into the mold. The refractory glaze was designed to be gas permeable during the pattern removal process but to fuse into a gas impermeable glaze layer at 2800 degrees F. and comprised the following materials:

Glaze potassium aluminosilicate—48 grams $CaCO_3$—20 grams

Kaolin ($Al_2O_3/SiO_2$)—111 grams

Minsil 550 silica ($SiO_2$)—278 grams sodium silicate—15 grams water—160 grams latex—48 grams The potassium aluminosilicate (Custer Feldspar) is available from Pacer Corporation. The $CaCO_3$ (whiting) is available from Kraft Chemical Company. The Kaolin ($Al_2O_3/SiO_2$) is available from Feldspar Corporation. The Minsil 550 silica ($SiO_2$) is available from Minco Inc. The sodium silicate is available from Aldrich Chemical Co. The latex is 68010 latex available from Reichhold Chemical Co.

A superheated nickel base superalloy was poured into the mold assembly in evacuated chamber 10 to fill the mold assembly as described above and then argon gas pressure of approximately 10 pounds absolute (0.6 atmosphere) was applied in the chamber within 0.5 seconds after mold filling as described above and lasting for a time of 3 to 6 seconds before evacuation of the chamber 10 was resumed to the original vacuum level. The castings removed from the mold assembly showed that all of the 0.020 inch high turbulators on the mold surface had been filled with the nickel base superalloy in contrast to previous trials under identical conditions but without the glaze coating on the mold assembly where almost none of the turbulators was filled.

Although the invention has been described above with respect to certain embodiments thereof, the invention is not so limited since changes, modifications and the like can be made thereto without departing from the spirit and scope of the invention as set forth in the appended claims.

We claim:

1. A method of casting a molten metallic material, comprising providing a mold having a mold wall for contacting the molten metal, said mold wall including a refractory barrier to gas permeability effective to delay gas pressure equalization between an exterior and interior of said mold wall, introducing the molten metallic material into said mold under a first pressure and then applying gaseous pressure higher than said first pressure to said material in the mold.

2. The method of claim 1 wherein said material is flowed by gravity from a pour cup through a mold passage to said mold cavity to fill said mold cavity and said gaseous pressure is applied rapidly enough after filling said mold cavity to reduce localized void regions present therein at said mold wall.

3. The method of claim 1 wherein said gaseous pressure is applied rapidly enough after filling said mold cavity to reduce localized void regions present therein at a surface of a core disposed in said mold.

4. The method of claim 1 wherein said barrier renders said mold wall substantially gas impermeable.

5. The method of claim 1 wherein said gaseous pressure is applied to said material in said mold immediately after filling the mold cavity while said mold resides in a casting furnace.

6. The method of claim 1 wherein the gaseous pressure comprises a pressurized gas that is substantially nonreactive with the melt.

7. The method claim 1 wherein the gas comprises an inert gas.

8. The method of claim 1 wherein said refractory barrier comprises a refractory glaze that reduces gas permeability.

9. The method of claim 1 wherein said mold wall includes surface features that have a height to width ratio of 1.0 or greater.

10. A method of investment casting a molten metallic material, comprising providing a shell mold having a mold wall forming a mold surface of a mold cavity for contacting the molten metal, said mold wall being substantially gas impermeable, introducing the molten metallic material into said mold in a casting chamber under a first pressure by flowing said material by gravity from a pour cup through a passage to said mold cavity to fill said mold cavity, and then providing in said chamber a gaseous pressure higher than said first pressure.

11. The method of claim 10 wherein said gaseous pressure is applied rapidly enough after filling said mold cavity to reduce localized void regions present therein at said mold surface.

12. The method of claim 10 wherein said gaseous pressure is applied to said material in said mold immediately after filling said mold cavity while said mold resides in a casting furnace.

13. The method of claim 10 wherein said mold wall includes a refractory glaze to reduce gas permeability.

* * * * *

UNITED STATES PATENT AND TRADEMARK OFFICE

CERTIFICATE OF CORRECTION

PATENT NO. : 6,640,877 B2
DATED : November 4, 2003
INVENTOR(S) : Mark L. Soderstrom et al.

It is certified that error appears in the above-identified patent and that said Letters Patent is hereby corrected as shown below:

Title page,
Item [75], Inventors, delete the address "Whitehall, MI (US)" for "Brad J. Murphy" and replace with: -- Brad J. Murphy, Montague, MI (US) --.

Signed and Sealed this

Twenty-eighth Day of September, 2004

JON W. DUDAS
*Director of the United States Patent and Trademark Office*